US005595036A

United States Patent [19]

Nakamura

[11] Patent Number: 5,595,036

[45] Date of Patent: Jan. 21, 1997

[54] ROOF SHINGLES

[75] Inventor: Hiroki Nakamura, Arida, Japan

[73] Assignee: Globe Japan Corporation, Osaka, Japan

[21] Appl. No.: 498,892

[22] Filed: Jul. 6, 1995

[30] Foreign Application Priority Data

Aug. 23, 1994 [JP] Japan ..... 6-198323

[51] Int. Cl.[6] ..... F04D 1/12

[52] U.S. Cl. ..... 52/554; 52/518; 52/557; D25/140

[58] Field of Search ..... 52/311.2, 518, 52/554, 555, 557, 608, 610, 611, 574; D25/138, 139, 140, 157; 404/29, 38, 39, 41, 42

[56] References Cited

U.S. PATENT DOCUMENTS

| | | | |
|---|---|---|---|
| 2,197,972 | 4/1940 | Ernst | 52/557 |
| 2,642,823 | 6/1953 | Williams | 52/554 |

*Primary Examiner*—Michael Safavi
*Attorney, Agent, or Firm*—Wenderoth, Lind & Ponack

[57] ABSTRACT

A roof single includes a substantially rectangular tab extending from an end portion of a widthwisely extending eave side of a shingle body. When a long side of the rectangular tab is X and a short side thereof is Y, the shingle body has a width of 2X and a depth of 2Y+a (where a>0).

15 Claims, 12 Drawing Sheets

ROOF SHINGLES

BACKGROUND OF THE INVENTION

The present invention relates to roof shingles of a flat sheet form for covering a roof.

In common roofing, rows of shingles 101 (101*a* to 101*c*) having substantially a rectangular shape are placed in parallel so that their eave sides 102 align in a straight line, as shown in FIG. 15.

However, the parallel rows of the rectangular shingles 101 appear simple but fail to give any visual sense of quality.

Both ends of each the shingle 101 extending at right angles to the eave side 102 are exposed as abutting to one another. In appearance, rows of the shingles 101 hardly are decorative or stylish and exhibit a dull, plain expression. The shingles 101 may look not plain when they are physically increased in thickness. The more the thickness of the shingles 101 is increased, the harder their handling and laying will be. For example, it is not technically feasible to provide a cement-asbestos slate form of the shingle 101 with a thickness of more than 6 or 7 mm.

SUMMARY OF THE INVENTION

It is an object of the present invention, in view of the foregoing drawbacks, to provide roof shingles which appear decorative and stylish used, compared with a simple, dull appearance of parallel rows of conventional shingles, and simultaneously to provide a visually attractive appearance simulating an impression of thicker shingles.

For achievement of the above object of the present invention, a roof single according to the invention includes a shingle body having substantially a rectangular shape and a substantially rectangular tab extending from an end portion of a widthwisely extending eave side of the shingle body. In particular, the shingle is so sized that when a long side of the rectangular tab is X and a short side thereof is Y, the shingle body has a width of 2X and a depth of 2Y+a (where a>0).

Also, the roof shingle may have two decorative frills having an equal shape and respectively extending from an eave side of the rectangular tab and the eave side of the portion of the shingle other than the end portion from which the rectangular tab extends.

A roof shingle according to another aspect of the invention includes a shingle body having substantially a rectangular shape and a substantially rectangular tab extending from a center portion of a widthwisely extending eave side of the shingle body. The shingle is so sized that when a long side of the rectangular tab is X and a short side thereof is Y, the shingle body has a width of 2X and a depth of Y+a (where a>0).

It is noted that a is a marginal distance of overlap between two shingles to prevent entrance of rain water therebetween.

When laying the shingles on a roof, the shingles are placed in rows with the rectangular tabs of the shingles facing the eave of the roof. More particularly, the procedure starts with a first row of shingles being laid along the eave. Then, a second row of the shingles is placed so that the eave side of the rectangular tab of each shingle of the second row comes just over the eave side of the shingle body of the shingle of the first row. A third row of the shingles is laid so that the eave side of the tab of each shingle of the third row comes just over the eave side of the shingle body of the shingle of the second row. In the same manner, fourth and more rows of the shingles are installed.

As a result of repeating the above procedure, any two adjacent rows of shingles, e.g. the first and second rows or the second and third rows, are out of phase with each other by a distance of X in the widthwise direction and also by a distance of Y in the depthwise direction. In overall appearance, exposed four-sided regions of the shingles defined by the rectangular tabs are staggered from row to row. Simultaneously, the eave side of the rectangular tab of one shingle overlaps the eave side of the shingle body of another shingle, thus providing a double thickness.

DETAILED DESCRIPTION OF THE PREFERRED EMBODIMENTS

Preferred embodiments of the present invention will be described referring to the accompanying drawings.

Embodiment 1

Figure 1:
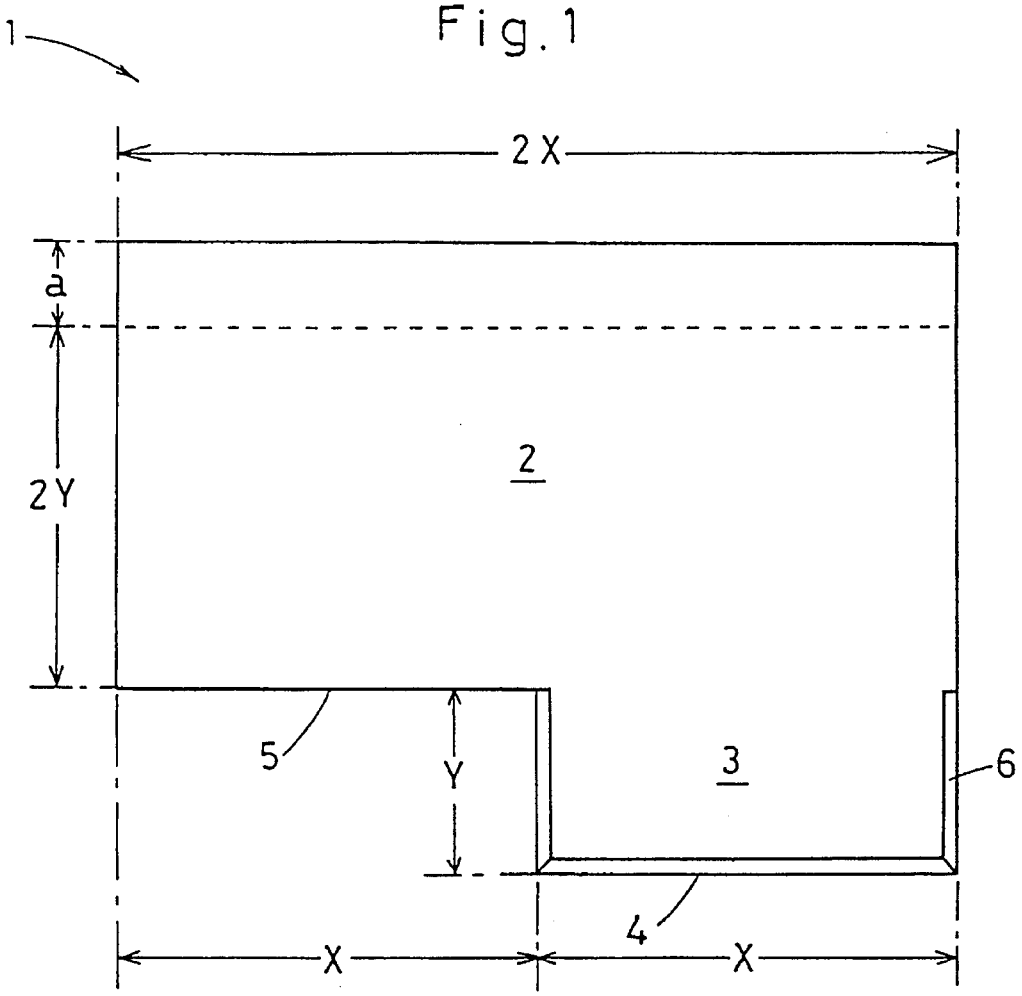
FIG. 1 is a plan view of a roof shingle of a first embodiment of the present invention.
Figure 2:
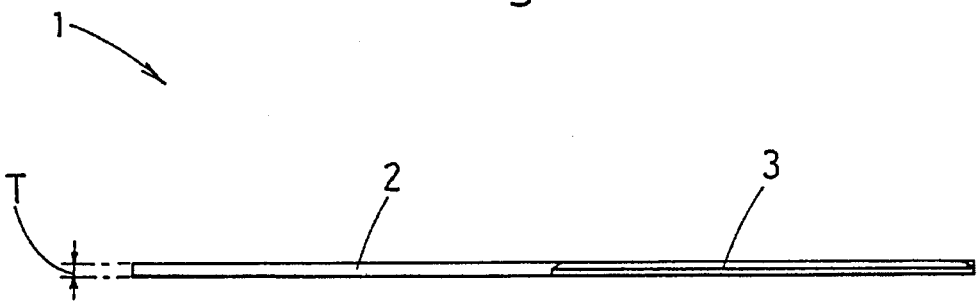
FIG. 2 is a front view of the roof shingle of FIG. 1.

FIGS. 1 and 2 are a plan view and a front view respectively showing a roof shingle according to Embodiment 1 of the present invention.

As shown, the shingle 1 has a sheet shape a may be formed by extruding a cement-asbestos material. The shingle 1 comprises a shingle body or body portion 2 having a rectangular shape and a rectangular tab or tab portion 3 extending outwardly from a right half of an eave side of the shingle body 2. The shingle 1 is sized so that when a long side of the rectangular tab 3 is X and a short side is Y, the shingle body 2 has a width of 2X and a depth of 2Y+a (where a>0) as shown in FIG. 1. Shingle 1 has a recess having a width X and a depth Y, and is L-shaped with five convex corners and one concave corner. Denoted by 4 is a long or eave side or edge of a tab 3, 5 is an eave side or edge of a left half of the eave side of the shingle body 2, 6 is a bevel formed in edges of the tab 3, and T is a thickness of the shingle 1. The tab 3 may extend from a left half of the eave side of the shingle body 2. The beveled edge 6 may be eliminated if desired.

A deepermost region of the shingle body 2 defined in FIG. 1 is a marginal area to be overlapped by a neighboring shingle 1 for preventing rain water from entering therebetween. The marginal area may have one or more water channels (not shown) grooved in the surface thereof to increase the effect of preventing entrance of rain water.

The dimensions of the shingle 1 may arbitrarily be determined. It is most desirable when X=303 mm, Y=130 mm, a=60 mm, and t=6.5 mm.

Figure 3:
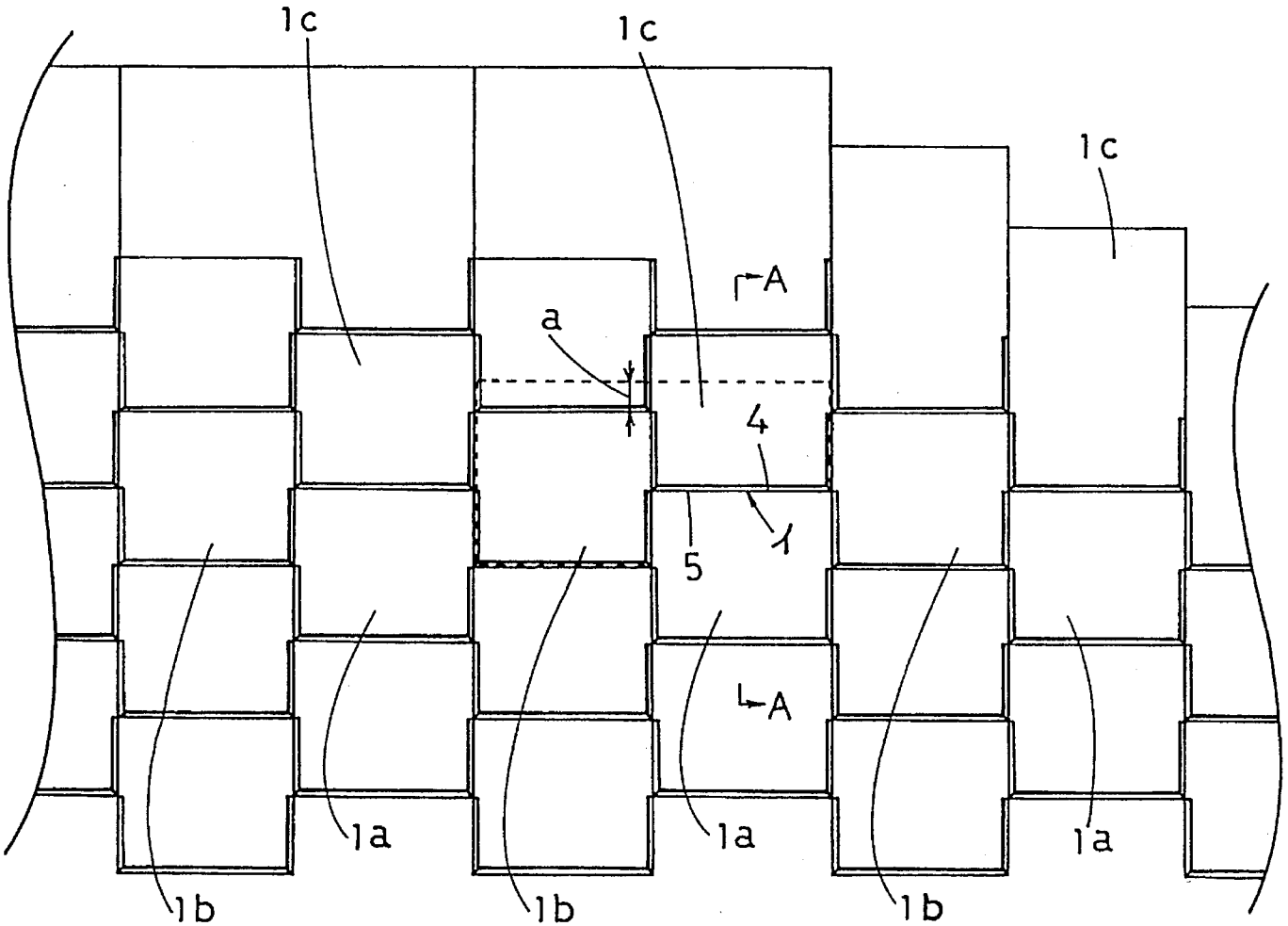
FIG. 3 is an explanatory view showing a laying pattern of shingles according to FIG. 1.
Figure 4:
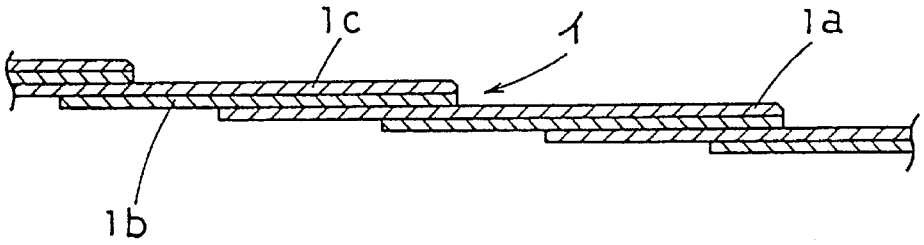
FIG. 4 is a cross sectional view taken along line A—A of FIG. 3.

Laying of the shingles 1 of Embodiment 1 will not be explained referring to FIGS. 3 and 4. The shingles 1 are widthwisely placed in rows with tabs 3 facing the eave of a roof. More particularly, a first row of shingles 1*a* is laid from left to right in FIG. 3. Then, a second row of shingles 1*b* is placed so that the eave side 4 of the tab 3 of each the shingle 1*b* comes just over the eave side 5 of the shingle body 2 of the preceding shingle 1*a*. As the two eave sides 4 and 5 are identical in length, which is equal to X, they coincide with each other in placement one over the other. A third row of shingles 1*c* is laid so that the eave side 4 of the tab 3 of each the shingle 1*c* comes just over the eave side 5 of the shingle body 2 of the shingle 1*b*. In the same manner, fourth and more rows of the shingles 1 are installed.

As a result of repeating the above procedure, any two adjacent rows of the shingles 1, e.g. the first and second rows or the second and third rows, are out of phase with each other by the length of X in the widthwise direction and also by the length of Y in the depthwise direction. More particularly, rectangular exposed regions of the shingles 1 are defined by X and 2Y are staggered from row to row, thus giving a unique, quality appearance as compared with a simple parallel-row appearance of conventional shingles.

The exposed region of the shingle 1 includes the eave side of the tab 3 (as denoted by the symbol λ in FIGS. 3 and 4) which is laid over the eave side 5 of the preceding shingle body 2, and thus the thickness of their overlapping is two times the thickness of the single 1, thereby simulating a heavy-duty roofing arrangement.

A shingle 1*c* of the third overlaps a shingle 1*a* of the first row by the marginal depth a. Thus, flow of rain water from the shingle 1*b* of the second row is prevented from entering beneath the eave side 4 of the shingle 1*a* of the first row.

Figure 5:
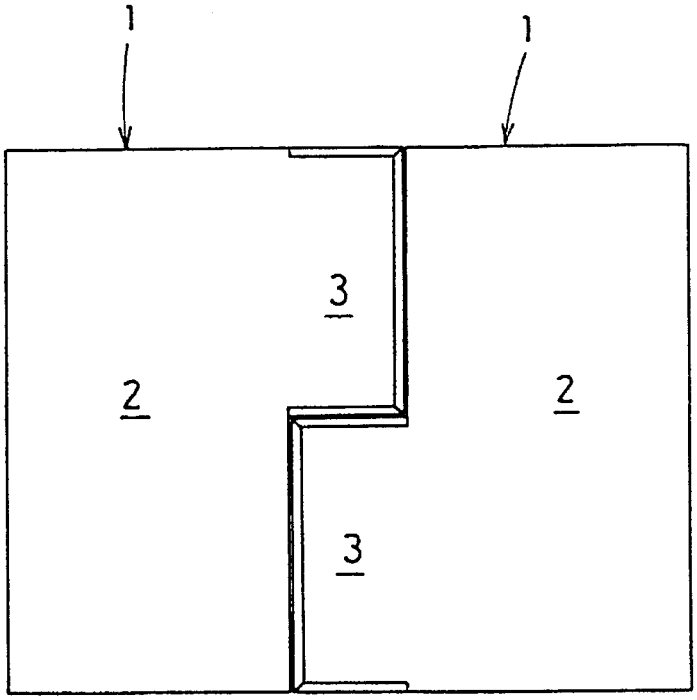
FIG. 5 is a plan view showing a pair of the shingles of FIG. 1 aligned for storage or transportation.

For transportation and storage, a pair of the shingles 1 may be aligned with the tab 3 of each single fitting in a corresponding cut=-out or recess of the other shingle, per FIG. 5. This assembly will protect the eave sides 4 and 5 from damage and will save space.

Figure 6:
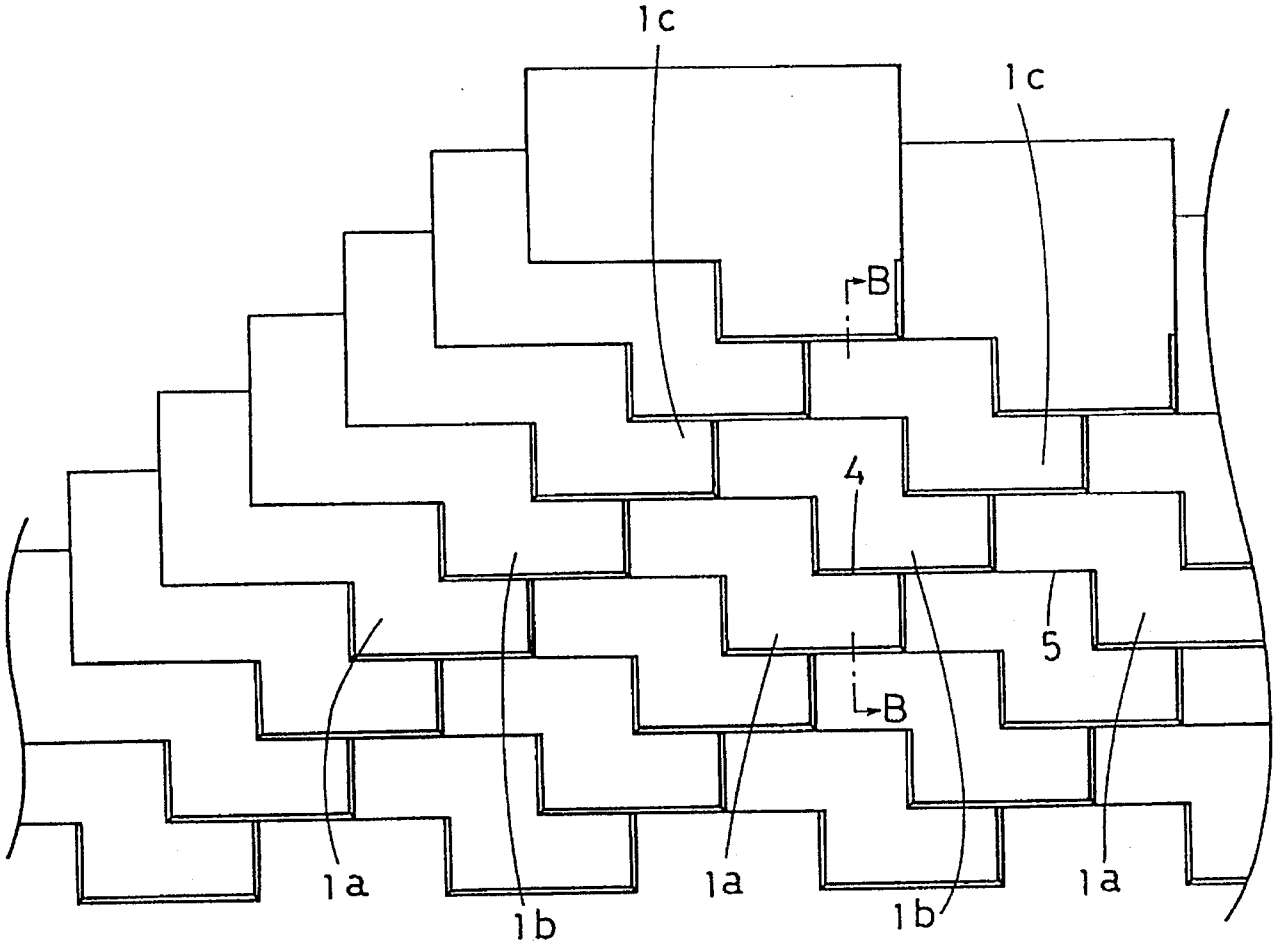
FIG. 6 is an explanatory view showing another laying pattern of the shingles of FIG. 1.
Figure 7:
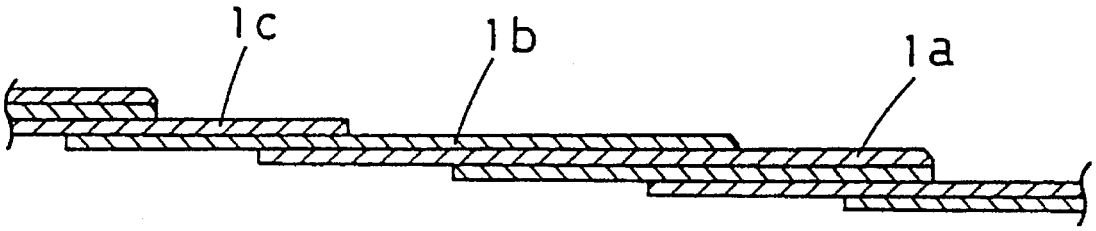
FIG. 7 is a cross sectional view taken along line B—B of FIG. 6.

FIG. 6 and 7 illustrate another laying pattern of the shingles 1. A first row of shingles 1*a* is installed from left to right or vice versa. A second row of shingles 1*b* is then placed so that the eave side 4 of the tab 3 of the shingle 1*b* of the second row overlaps half of the eave side 5 of the shingle body 2 of the shingle 1*a* of the first row. Similarly, a third row of shingles 1*c* is laid so that the eave side 4 of the shingle 1*c* of the third row overlaps half of the eave side 5 of the shingle 1*b* of the second row. Fourth and more rows are installed in the same manner.

As the result of repeating the above procedure, any two adjacent rows of the shingles 1, e.g. the first and second rows or the second and third rows, are out of phase with each other by a length of X/2 in the widthwise direction and also by the length of Y in the depthwise direction. More particularly, exposed regions of the shingles 1 having an approximately Z shape of 3X/2 in width and 2Y in depth appear in oblique rows, thus giving a more complex visual appearance than that shown in FIG. 3.

It will be understood that the laying of the shingles 1 of Embodiment 1 is not limited to the above described patterns.

Embodiment 2

Figure 8:
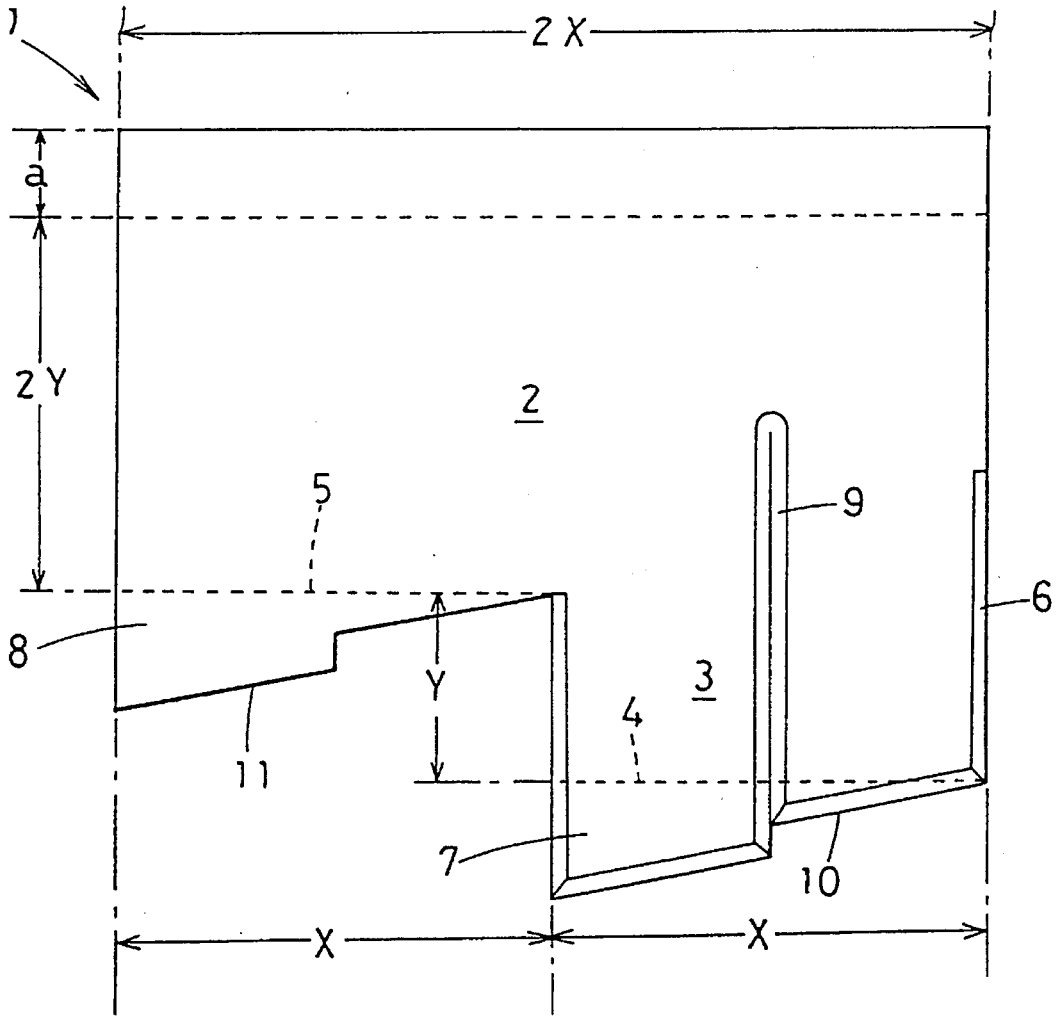
FIG. 8 is a plan view of a roof shingle of a second embodiment of the present invention.

FIG. 8 is a plan view of a roof shingle according to Embodiment 2 of the present invention.

As shown, the shingle 1 of this embodiment comprises a tab 3 having a decorative frill portion 7 extending from an eave side 4 thereof and a shingle body 2 having a decorative frill portion 8 extending from an eave side 5 thereof which is located next to the tab 3. The decorative frills 7 and 8 are formed integral with the tab 3 and the shingle body 2 respectively and are almost identical to each other in shape.

The tab 3 and its decorative frill 7 have beveled edges 6. A V-shaped slot 9 is provided in an upper surface of the tab 3 extending rectilinearly from a center of the eave edge 4 towards a roof peak side of the shingle and continues the beveled edges 6. Two eave sides of the decorative frills 7 and 8 are denoted by 10 and 11 respectively.

Figure 9:
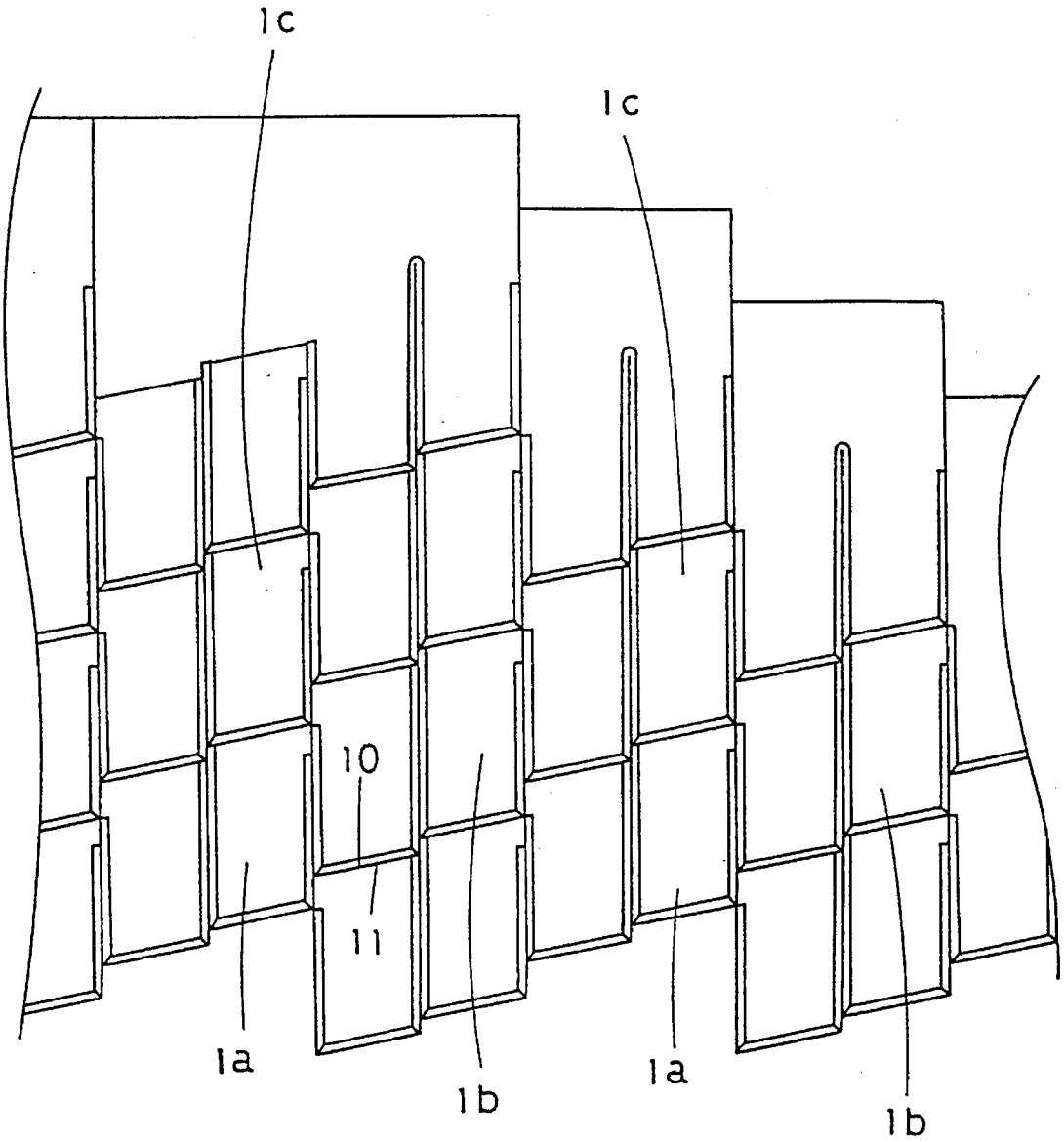
FIG. 9 is an explanatory view showing a laying pattern of shingles according to FIG. 7.

A laying pattern of the shingles 1 (1*a*, 1*b* and 1*c*) of Embodiment 2 is shown in FIG. 9 and is implemented similar to Embodiment 1 shown in FIG. 3. Rows of the shingles 1 are laid so that the eave side 10 of the decorative frill 7 of the shingle 1*b* of the second row overlaps the eave side 11 of the decorative frill 8 of the shingle 1*a* of the first row.

The shingles 1 of this embodiment appear more elaborate and attractive in use, because of their decorative frills 7 and 8, than those of Embodiment 1, thus giving a higher grate of, or at least different, visual appearance.

Embodiment 3

Figure 10:
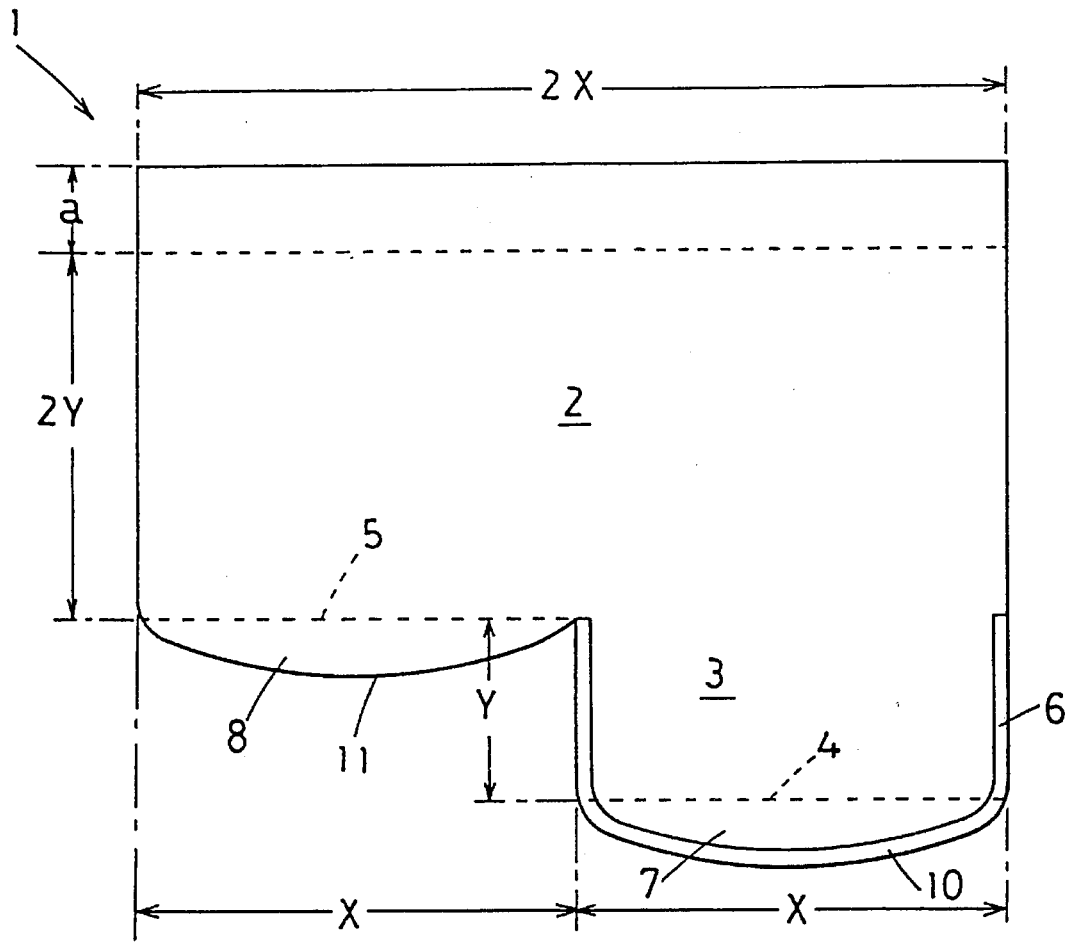
FIG. 10 is a plan view of a roof shingle of a third embodiment of the present invention.

FIG. 10 is a plan view of a roof shingle according to Embodiment 3 of the present invention.

As shown, the shingle 1 of this embodiment has two decorative frills 7 and 8 formed in an arcuate shape while its other dimensions are identical to those of Embodiment 2.

Figure 11:
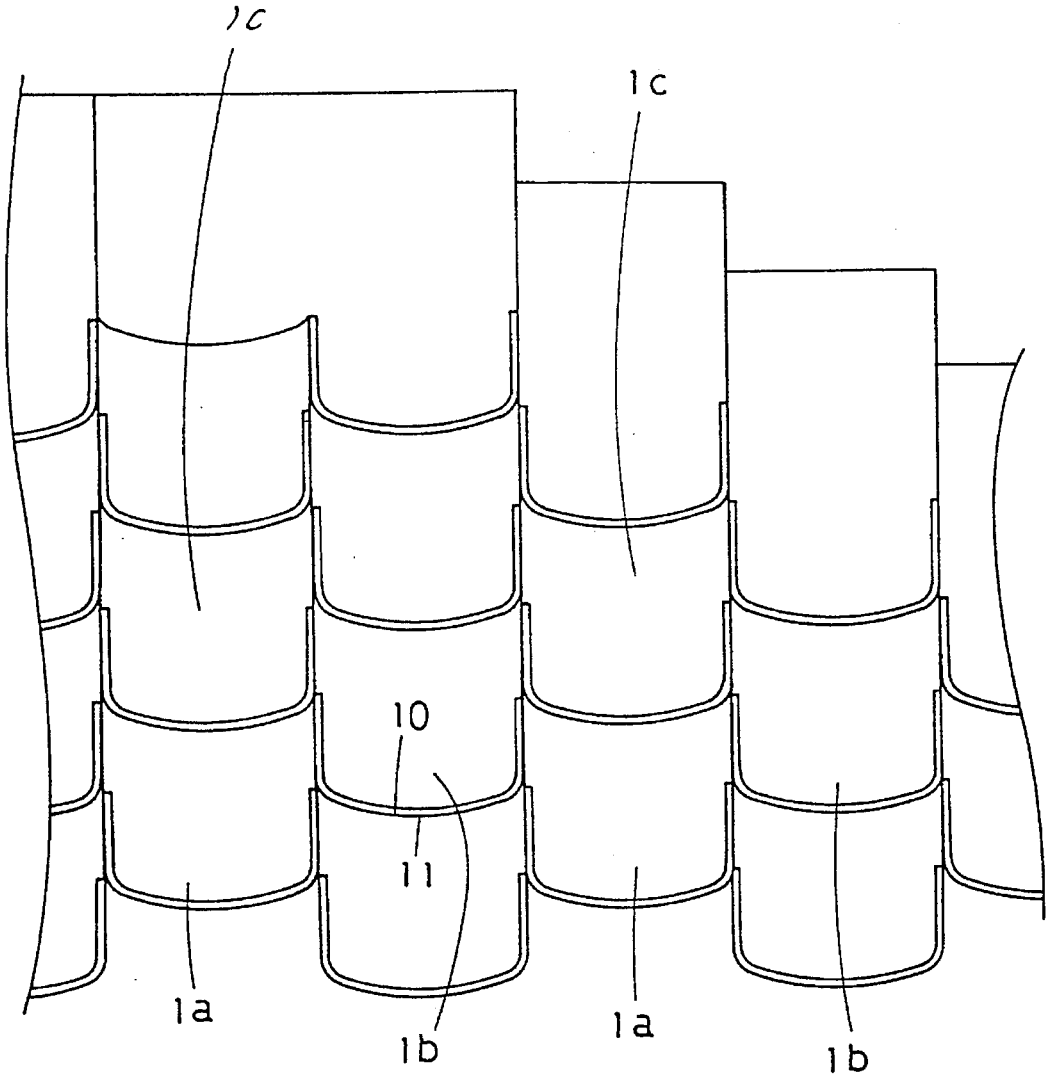
FIG. 11 is an explanatory view showing a laying pattern of shingles according to FIG. 10.

A laying pattern of the shingles 1 (1*a*, 1*b*, and 1*c*) is shown in FIG. 11 and is implemented in the same manner as Embodiment 2 of FIG. 9.

Using the shingles 1 of this embodiment, a roof can be furnished with a succession of curved lines.

It is also possible to lay the shingles 1 so that any two adjacent rows are out of phase by 2/X with each other, similar to the pattern of Embodiment 1 shown in FIG. 6.

The configuration of the decorative frills 7 and 8 is not limited to the illustrated embodiments and other appropriate shapes can be employed with equal success.

Embodiment 4

Figure 12:
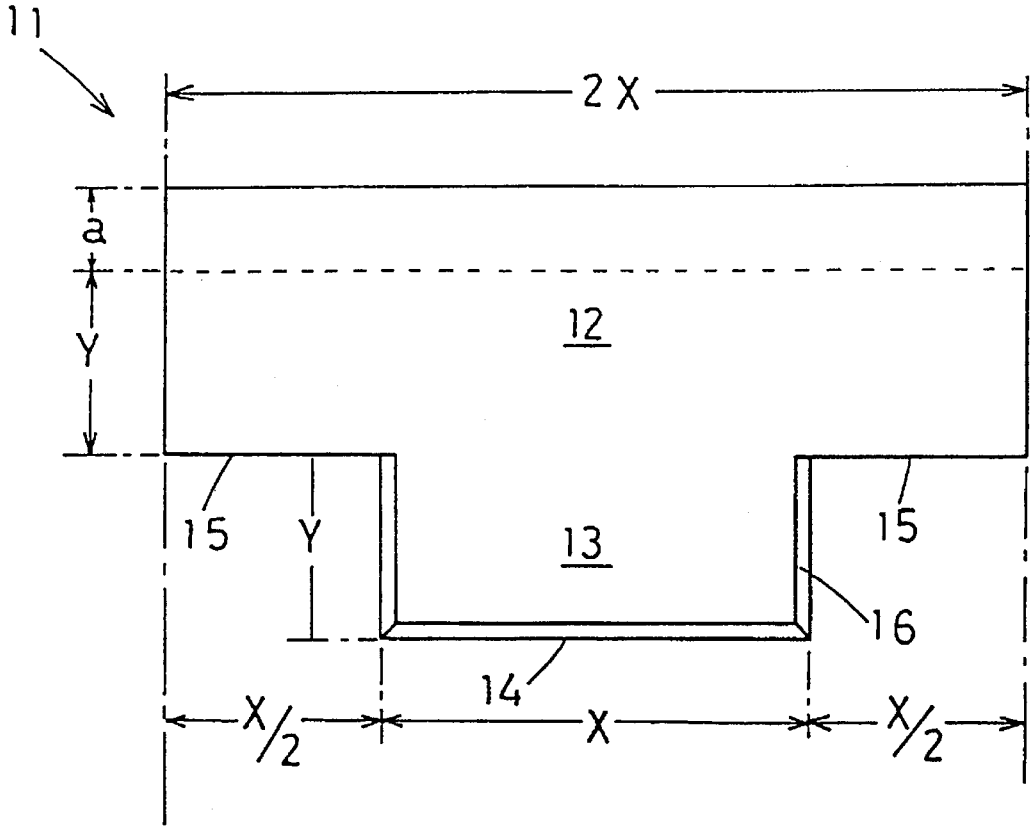
FIG. 12 is a plan view of a roof shingle of a fourth embodiment of the present invention.
Figure 13:
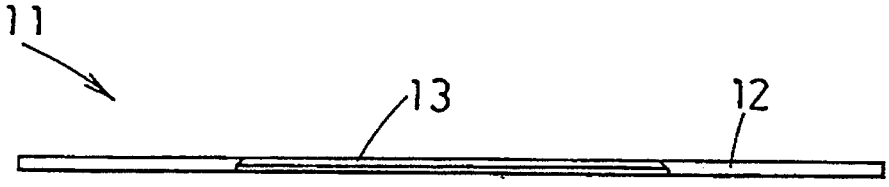
FIG. 13 is a front view of the roof shingle of Fig. 12.

FIGS. 12 and 13 are a plan view and a front view respectively showing a shingle 11 of Embodiment 4 of the present invention.

The shingles 11 comprises a shingle body 12 having a rectangular shape and a tab 13 extending from a center of an eave side of the shingle body 12. More specifically, the shingle 11 is sized so that when a long side of the rectangular tab 13 is X and a short side is Y, the shingle body 12 has a width of 2X and a depth of Y+a (where a>0) as shown in FIG. 12. Denoted by 14 is the long or eave side of the tab 13, 15 are eave sides of the shingle body 12 located on both sides of the tab 13, and 16 is beveled edges of the tab 13. A tab 13 may extend from a left or right half of the shingle body 12 rather than from the center thereof. Also, the beveled edge 16 may be eliminated if desired.

Figure 14:
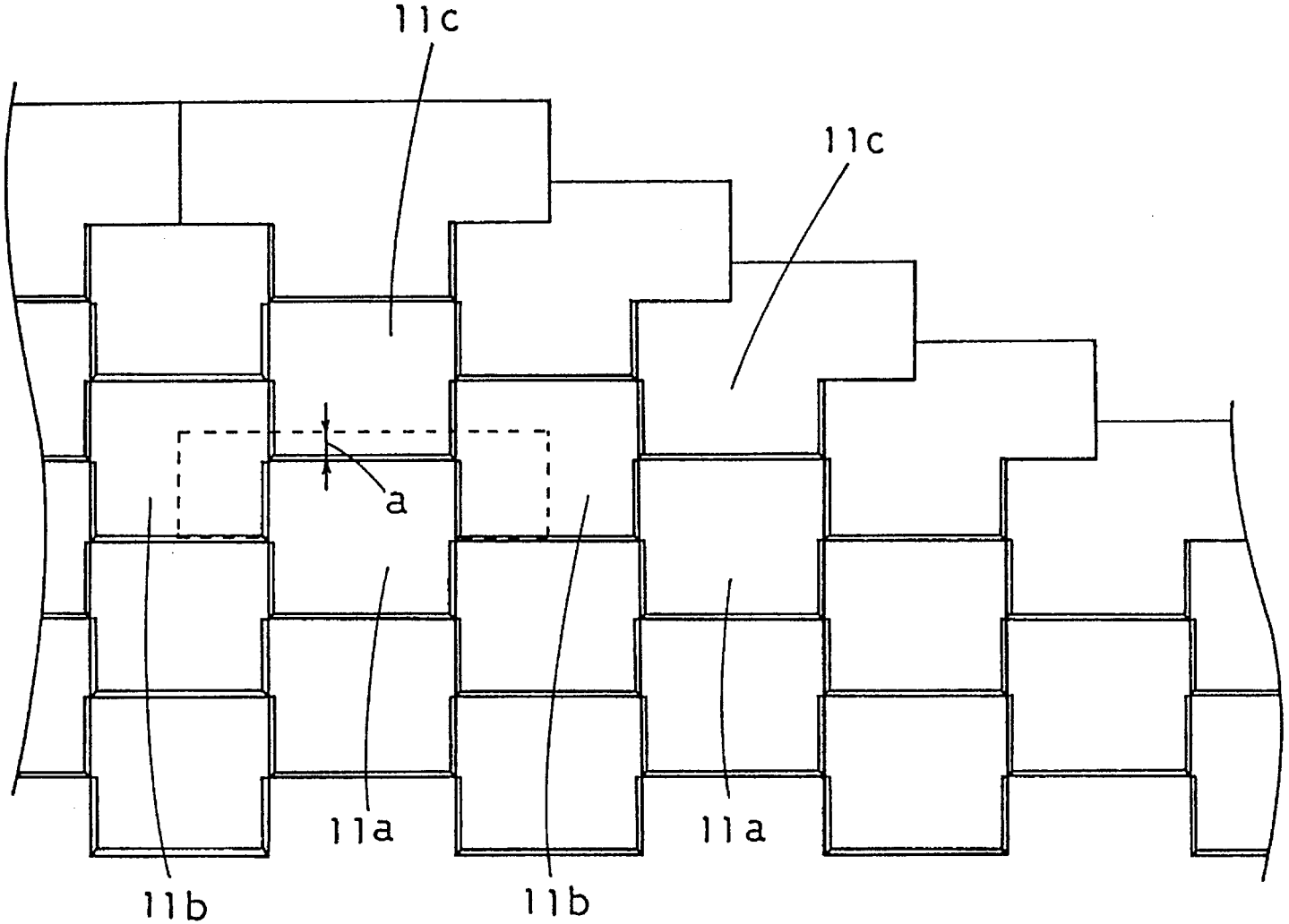
FIG. 14 is an explanatory view showing a laying pattern of shingles according to FIG. 12.
Figure 15:
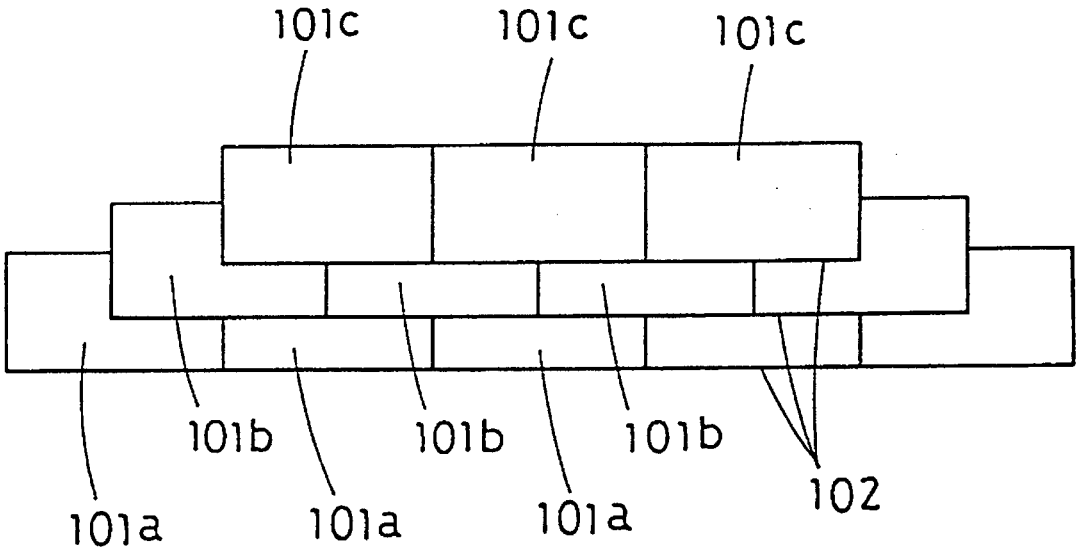
PRIOR ART Fig. 15
FIG. 15 is an explanatory view showing a laying pattern of conventional shingles.

Laying of the shingles 11 of Embodiment 4 will now be explained referring to FIG. 14. The shingles 11 are widthwisely placed in rows with tabs 13 facing the eave of a roof.

More particularly, a first row of shingles 11*a* is laid along the eave. Then, a second row of shingles 11*b* is placed so that the eave side 14 of the tab 13 of each the shingle 11*b* comes just over the two adjacent eave sides 15 of respective shingles 11*a*. The total length of the two adjacent eave sides 15 is X and is identical to that of the eave side 14 of the tab 13 which thus overlaps such two adjacent eave sides 15. A third row of shingles 11*c* is laid so that the eave side 14 of the tab 13 of each shingle 11*c* comes just over the two adjacent eave sides 15 of respective shingles 11*b* of the second row. In the same manner, fourth and more rows of the shingles 11 are installed. As the result of repeating the above procedure, a shingle pattern on a roof similar to that of Embodiment 1 shown in Fig. 3 is obtained.

Since the interface between any two adjacent shingles 11 in each row of this embodiment is covered with the tab 13 of a shingle 11 of the succeeding row, the depth of the shingle body 12 may be as small as Y+a. Accordingly, a ratio of exposed regions of the shingles 11 to the total areas of the same is increased, thus saving space and material.

What is claimed is:

1. A roof shingle comprising:

a shingle body portion having substantially a rectangular shape with a widthwise dimension and a depthwise dimension, said body portion having a lower eave side to be directed downwardly toward an eave of a roof when said shingle is installed on the roof;

a tab portion extending from an end portion of said eave side of said body portion, said tab portion having substantially a rectangular shape with a widthwise dimension and a depthwise dimension, said tab portion having opposite side edges extending in said depthwise direction and an eave side edge extending between said opposite side edges, said opposite side edges and said eave side edge of said tab portion being beveled; and said body portion and said tab portion being relatively configured such that said widthwise dimension of said tab portion is X, said widthwise dimension of said body portion is 2X, said depthwise dimension of said tab portion is Y, and said depthwise dimension of said body portion is 2Y+a, wherein a>0.

2. A roof shingle as claimed in claim 1, wherein said widthwise dimension of said body portion is greater than said depthwise dimension thereof, and said widthwise dimension of said tab portion is greater than said depthwise dimension thereof.

3. A roof shingle as claimed in claim 1, wherein said body portion has unbeveled edges.

4. A roof shingle as claimed in claim 1, wherein said body portion and said tab portion are unitary and form said shingle as a one-piece article.

5. A roof shingle as claimed in claim 1, wherein said body portion and said tab portion define together an L-shaped configuration having five convex corners and one concave corner.

6. A roof shingle as claimed in claim 1, wherein said tab portion has extending from an eave side only thereof a decorative frill portion.

7. A roof shingle as claimed in claim 6, wherein said decorative frill portion is inclined to said widthwise and depthwise dimensions.

8. A roof shingle as claimed in claim 6, wherein said decorative frill portion is curved.

9. A roof shingle as claimed in claim 6, wherein said body portion has extending from said eave side only thereof, at an end portion thereof opposite from said tab portion, a decorative frill portion.

10. A roof shingle as claimed in claim 9, wherein said decorative frill portion of said body portion is inclined to said widthwise and depthwise dimensions.

11. A roof shingle as claimed in claim 9, wherein said decorative frill portion of said body portion is curved.

12. A roof shingle as claimed in claim 9, wherein said decorative frill portion of said body portion has a shape the same as said decorative frill portion of said tab portion.

13. A roof shingle as claimed in claim 1, wherein said body portion has extending from said eave side only thereof, at an end portion thereof opposite from said tab portion, a decorative frill portion.

14. A roof shingle as claimed in claim 13, wherein said decorative frill portion is inclined to said widthwise and depthwise dimensions.

15. A roof shingle as claimed in claim 13, wherein said decorative frill portion is curved.

* * * * *